United States Patent [19]

Hodak

[11] Patent Number: 4,843,658

[45] Date of Patent: Jul. 4, 1989

[54] SWIMMING POOL AND METHOD OF CONSTRUCTION

[76] Inventor: Michael L. Hodak, 700 McMurray Rd., Bethel Park, Pa. 15102

[21] Appl. No.: 130,627

[22] Filed: Dec. 8, 1987

[51] Int. Cl.[4] ..... E04H 3/18; E04H 7/18; E02D 19/00; E02D 27/00

[52] U.S. Cl. ..... 4/506; 4/507; 52/169.5; 52/169.7; 52/169.9

[58] Field of Search ..... 4/506, 507, 510, 487, 4/488; 52/169.7, 169.8, 169.9, 309.1, 309.8, 309.12, 309.13, 169.5, 169.14

[56] References Cited

U.S. PATENT DOCUMENTS

| | | | |
|---|---|---|---|
| 3,072,921 | 1/1963 | Hegerfeld | 52/169.7 |
| 3,371,455 | 3/1968 | Fox | 52/169 |
| 3,416,165 | 12/1968 | Pereira | 4/506 |
| 3,419,916 | 1/1969 | Schankler | 52/169.7 |
| 3,468,088 | 9/1969 | Miller | 52/250 |
| 3,638,378 | 2/1972 | Russ, Jr. | 52/169.9 |
| 3,654,765 | 4/1972 | Healy et al. | 52/169.5 |
| 3,668,829 | 6/1972 | Nelson | 52/169.5 |
| 3,748,810 | 7/1973 | Mattingly | 52/169.7 |
| 3,959,830 | 6/1976 | van den Broek | 4/506 |
| 3,991,530 | 11/1976 | Scourtes | 52/169.7 |
| 4,015,379 | 4/1977 | Colson, Jr. | 52/169.1 |
| 4,044,514 | 8/1977 | Rubin et al. | 52/169.7 |
| 4,077,173 | 3/1978 | Rozanski | 4/506 |
| 4,115,977 | 9/1978 | Bertsch | 52/169.8 |
| 4,227,361 | 10/1980 | Miller | 52/742 |
| 4,306,393 | 12/1981 | Shelton | 52/169.7 |
| 4,407,102 | 10/1983 | Boyack | 52/169.7 |
| 4,548,005 | 10/1985 | Glonek et al. | 52/155 |
| 4,641,465 | 2/1987 | Boyle | 52/127.1 |

*Primary Examiner*—Henry J. Recla
*Assistant Examiner*—J. Casimer Jacyna
*Attorney, Agent, or Firm*—Webb, Burden, Ziesenheim & Webb

[57] ABSTRACT

A swimming pool of the liner type, with an improved sidewall construction. The sidewall comprises a plurality of concrete slabs cast between spaces defined by inner and outer vertical walls and vertical studs spaced therein. The inner wall is preferably formed of a rigid pressure treated wood material and bears against the pool liner. A continuous upper sill and a lower footer of concrete are cast integrally with the sidewall slabs to join adjacent respective slab portions around the upper and lower perimeters of the pool. The sidewall slabs and the upper sill preferably contain steel reinforcement bars.

16 Claims, 2 Drawing Sheets

SWIMMING POOL AND METHOD OF CONSTRUCTION

BACKGROUND OF THE INVENTION

My invention relates generally to swimming pools and to methods for constructing such pools. More particularly, the present invention is directed to an improved in-ground swimming pool construction of the vinyl liner type having the structural advantages of a concrete-walled pool but with the economic attributes of a liner pool.

Heretofore, in-ground swimming pools have been built in a variety of ways, ranging from very expensive constructions to those costing considerably less. Pools made of poured or gunned concrete, tile or concrete block are generally relatively expensive due to the high cost of materials and the intensive job-site labor required to build them. A considerable degree of high cost, skilled labor is also needed during the construction of these pools. Less expensive, in-ground pools are represented by the so-called vinyl-liner type which require considerably less time to build but are generally less durable than the aforementioned class. Liner leakage and wall collapse problems are not uncommon among such liner pools. A variety of complicated cross-bracing arrangements have been proposed to support the sidewalls of such liner pools so as to resist sidewall loading since wall loads can be very great under high ground water conditions. Exemplary of such cross-braced sidewalls are the liner pools disclosed in U.S. Pat. Nos. 3,371,455 and 4,548,005.

Intermediate the expensive concrete designs and the less expensive vinyl liner constructions, are pools having various combinations of sidewalls and bottoms, such as the concrete backed fiberglass wall and concrete bottom construction disclosed in U.S. Pat. No. 3,468,088. While this arrangement offers an excellent pool structure in terms of wall strength and durability, it also requires time-consuming labor in fitting the various components at the job site and requires a somewhat high degree of expertise in forming and finishing the concrete bottom. The required skilled labor for such concrete finishing is not always readily available. A concrete block, vinyl liner pool is disclosed in U.S. Pat. No. 3,419,916. Needless to say, these types of pools are relatively expensive to manufacture and install.

My invention solves many of the problems heretofore encountered in known swimming pool structures by providing a pool and method for constructing same, preferably of an in-ground type, which offers the wall strength of a concrete construction at far less cost. This is accomplished by providing a vinyl liner backed by a unique, but relatively inexpensive sidewall construction, including an integral footer and sill of poured, reinforced concrete.

SUMMARY OF THE INVENTION

Briefly stated, a swimming pool according to the present invention has a conventional lining of waterproof vinyl or like material, resting on a conventional bottom of compacted sand or of a known cement and vermiculite mix, of the type commonly employed in liner pools. The sidewall perimeter of the pool comprises a first inner wall adjacent the liner, constructed preferably of a wooden sheet material, such as a pressure treated wood, such as a "Wolmanized" brand sheet of a closed cell, plywood material. A second outer wall form is spaced from the inner wall and generally parallel thereto. The outer wall is preferably constructed of a less expensive wood sheet material such as particle board. The upper edge of the outerwall preferably carries an outwardly flared gutter of sheet metal around the perimeter thereof. Vertically extending, spaced-apart studs are secured in the space between the inner and outer walls along with vertically extending, spaced-apart reinforcement steel bars or "re-bars". The lower edge of the outer sidewall is spaced vertically upwardly from the lower edge of the inner sidewall to form a continuous footer opening along the lower wall perimeter. Concrete is poured into the spaces defined between the inner and outer wall forms and along the space at the lower wall perimeter, to form a plurality of reinforced concrete sidewall slabs between the vertical studs, along with an integral footer joining the slabs around the lower perimeter of the pool. The footer joins each of the sidewall slabs to form an integral structure at the bottom of the pool sidewall. An integral, upper sill of reinforced concrete is also poured in the gutter around the upper perimeter to join each of the slabs at the upper region thereof. Perimeter drain means are also preferably provided in the form of a perforated pipeline laid in a gravel bed which is positioned above the continuous perimeter footer. The excavation is backfilled over the footer and against the outer wood sidewall form to complete the vertical wall construction. In the assembled condition, the reinforced concrete sidewall with integral concrete footer and upper sill offers superior structural resistance to inwardly directed ground water side loading, as well as outward pool pressures, while also providing a substantially longer service life than commonly used vinyl liner pool wall components of wood or steel. The concrete work is accomplished through the use of the above-described pouring forms which requires no high-cost, skilled finishing labor.

DETAILED DESCRIPTION OF THE INVENTION

Figure 1:
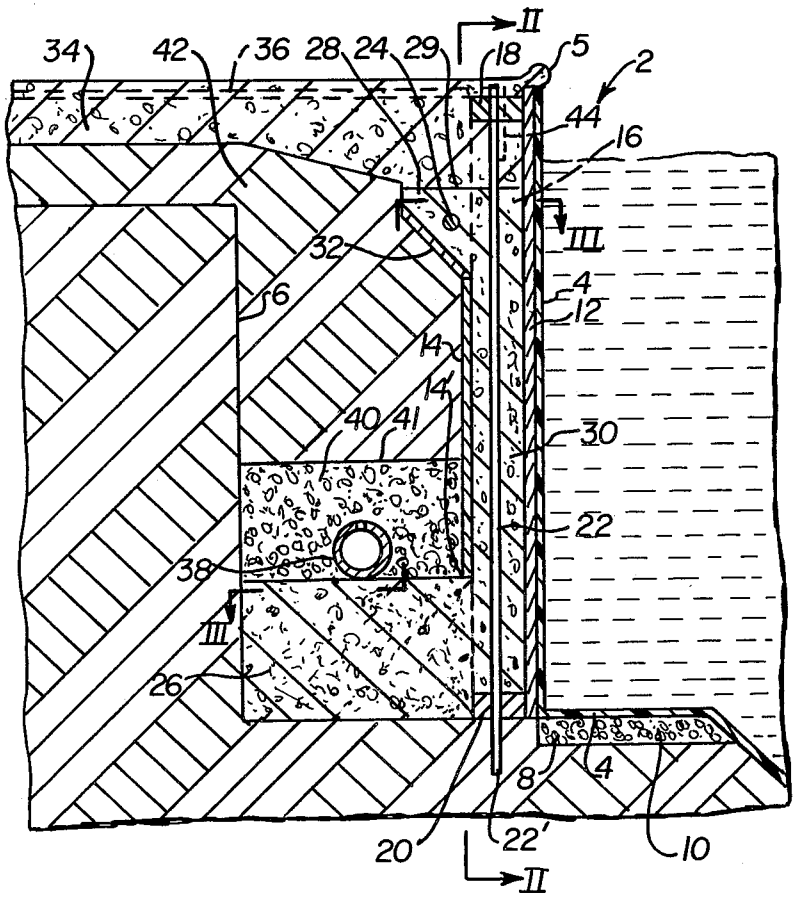
FIG. 1 is a partial cross-sectional end view of a pool sidewall constructed according to the present invention.
Figure 3:
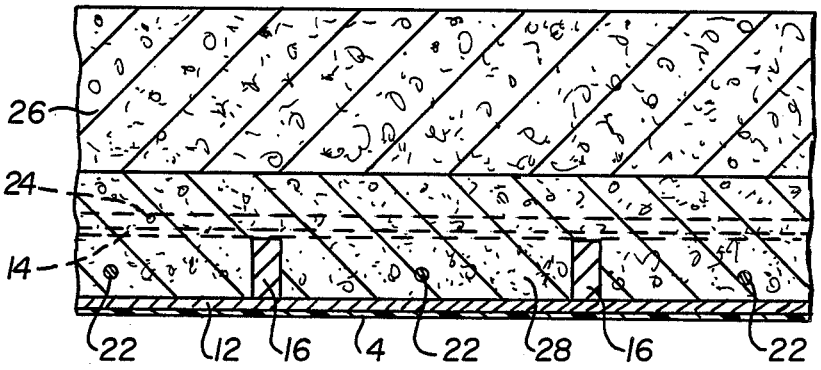
FIG. 3 is a partial sectional plan view of the sidewall taken along line III of FIG. 2.

Referring now to FIG. 1 of the drawings, a swimming pool, generally designated by reference numeral 2, is depicted in a preferred form constructed in accordance with the present invention. The pool 2 includes an inner liner 4 of a conventional type, for example, vinyl of about 20 gauge in thickness. The bottom of the pool liner 4 rests on a conventional layer 10 of sand or a cement/vermiculite mixture which bears against a bottom excavation level 8. The construction details of such pool bottoms are well known in the art and need not be described in any further detail.

The novel sidewall construction of my invention includes an inner rigid wall form 12 of a sheet material, preferably a long service life, pressure-treated plywood, such as sheet material sold under the trademark "Wolmanized" brand pressure treated lumber. The inner wall 12 has at least one smooth face which bears against the vinyl liner 4 so as to provide a cosmetically pleasing, smooth liner surface when the pool is filled with water. The inner wall 12 may be conveniently formed of sheets of 4 feet high by 8 feet long by ½ inch thick sheets of the pressure-treated closed cell plywood material. The inner wall form 12 could also be molded in sheet sections from a polymeric composition, such as "Rovel" brand plastic material manufactured by the Uniroyal Company.

An outer vertical wall form 14 is positioned outwardly from the inner wall 12 and generally parallel thereto to define a space therebetween which acts as form to permit the casting of concrete wall slabs 30 therebetween. The outer wall form 14 need not be constructed of expensive pressure treated wood since it can be permitted to disintegrate with time. Therefore, wall 14 may be constructed of a less costly material, such as particle board sheets, of ⅜ inch in thickness, for example. The spacing between the inner and outer wall forms 12 and 14 is obtained through the means of a plurality of spaced-apart, vertically extending studs 16, for example, of 2"×4" pressure treated wood, spaced-apart at, for example, 16-inch centers. Top and bottom horizontal wooden beams 18 and 20 are secured to the respective ends of the vertical studs 16 to complete the wall frame structure which is sandwiched between the inner wall 12 and outer wall 14.

A lower edge 14' of the outer wall 14 is spaced upwardly from the lower framing beam 20 at the bottom of the inner wall 12 to form an opening to permit communication between a continuous concrete footer 26 and the concrete wall slabs 30, as will be explained in greater detail hereinafter. Likewise, the upper edge 14" of the outer wall 14 is spaced downwardly a distance from the upper edge of the inner wall 12 and is fitted with an upwardly sloped gutter 32 of, for example, sheet metal, which facilitates the pouring of the walls 30 and also creates an outwardly extending form for the formation of a continuous upper concrete sill 28 which joins each of the wall slabs 30 around the upper pool perimeter. Hence, the gutter 32 not only functions as a pouring funnel to efficiently direct the cast concrete into the openings forming wall slabs 30 but also functions as a form for the sill 28 at the conclusion of the concrete pouring operation.

Vertical reinforcing rods or bars 22 of steel also known as "re-bar" are positioned midway between each of the studs 16. A conventional number 4 sized re-bar (½" diameter) is suitable for the bars 22. Pairs of vertically aligned holes are drilled through the upper and lower horizontal beams 18 and 20 to receive each of the bars 22 therein. The lower ends 22' of each of the vertical steel reinforcement bars 22 are preferably driven into an unexcavated earthbed, FIG. 1, a given distance to establish further anchoring points for the sidewall.

Figure 2:
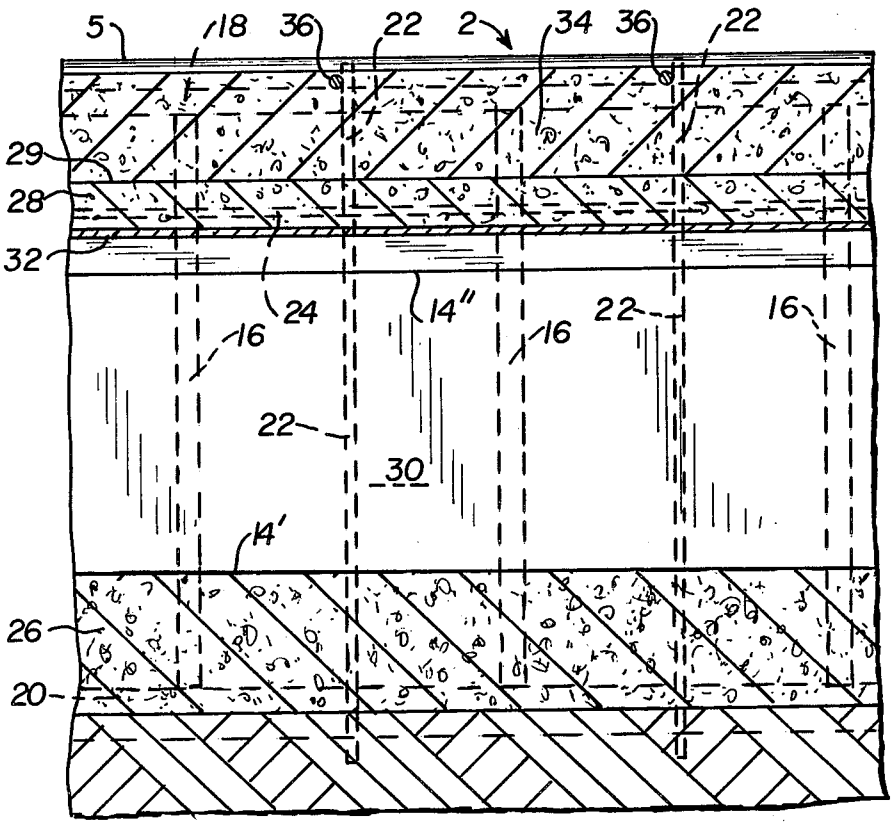
FIG. 2 is a partial sectional side view of the sidewall taken along line II—II of FIG. 1.

In constructing the pool wall of the present invention, the bottom excavation 8 and a side excavation 6 are made in accordance with known earth-moving techniques, such as with a back hoe, for example, to a size slightly in excess of the desired finished pool dimensions. The wall forms, comprising the inner wall 12, vertical studs 16, horizontal beams 18 and 20 and the outer wall 14, are placed around the perimeter of the pool in the desired size and configuration to form a continuous bearing wall for later placement of the liner 4. The wall sections may be partially or wholly prefabricated away from the job site or they may be fabricated on-site. The vertical re-bar 22 is driven into place and the walls are plumbed for straightness and adjusted for proper elevation in preparation for concrete pouring. After the wall forms are properly set, the continuous concrete footer 26 is poured around the lower perimeter of the pool. Concrete is also poured into the spaces between the inner and outer walls 12 and 14 to form the plurality of individual, reinforced wall slabs 30, separated by the vertical studs 16. The slabs 30 are continuously poured with the aid of the outwardly sloped gutter 32 of sheet metal which is attached at the upper edge 14" of the outer wall 14 to direct the concrete flow into the wall spaces 30. The concrete wall slabs 30 are poured immediately after or nearly concurrently with the pouring of the footer 26 so that the concrete of the footer 26 is in a non-set condition and joins with the slabs 30 to solidify therewith so as to form a homogeneous concrete structure between adjacent slabs 30. The wall slabs 30 are joined by the footer 26 around the front faces of each of the studs 16 in the space between the lower edge 14' of the inner wall 14 and the lower wall beam 20, see FIGS. 1 and 2. A unitized, concrete structure is thus formed by the footer 26 and the joined wall slabs 30.

The concrete is continuously cast upwardly along the wall slabs 30 to a level above the top of the edge 14" of the inner wall board 14. Due to the fact that the gutter 32 slopes outwardly from wall 14, the cast concrete extends beyond the outer faces of the studs 16. The outwardly sloped gutter 32 thus permits the concrete to flow around the faces of the studs 16 to join the unset concrete in each of the wall slabs 30 around the top thereof. Hence, a unitized concrete sill 28 is formed therearound with the aid of gutter 32. A continuous overlapping array of horizontally extending re-bar 24 is also preferably laid in place during the pouring of the sill 28. The bars 24 are covered by concrete until the pour reaches a level indicated by reference numeral 29 in FIGS. 1 and 2 of the drawings. In this manner, the upper perimeter of the pool wall is continuously steel reinforced. The continuous concrete sill 28 with steel reinforcement bars 24 thus structurally supports the concrete wall slabs 30 since the concrete is integral therewith.

The concrete footer 26, wall slabs 30, and top sill 28 are poured with a minimum of skilled labor since no concrete surface finishing is required. Heretofore such concrete finishing work required a high degree of skill and was very time-consuming in concrete-walled pools. After pouring, the footer 26 is preferably backfilled with a bed of gravel. Conventional perforated drain pipes 38 are buried in the gravel bed and extend around the pool periphery to keep subterranean water from accumulating therearound. A layer of building paper is placed on top of the gravel bed and earthen backfill 42 is then compacted therearound between the wall excavation 6 and the outer wall 14. If desired, a conventional perimeter deck or sidewalk 34 of concrete may also be poured as shown in FIG. 1. A conventional steel reinforcement grid 36 is embedded in the concrete 34 with a bent return bar section 44 tied to the top portions of the vertical re-bars 22 of the sidewall. The concrete 34 of the deck need not be integral or set with the sill 28 but, rather, can be poured over the sill 28 after the surface 29 has hardened. A conventional strip of coping 5 is applied around the pool perimeter not only as a decorative feature but also to hold the top of the vinyl liner 4 in place therearound in a known manner.

The wall construction of the present invention is capable of withstanding severe side loads from subterranean ground water when the earth is saturated and the pool empty. The wall is also capable of supporting the lateral water loads at a normal wall height of 42 inches when the pool is filled, even without any sidewall backfill. Hence, the sidewall construction of the invention is suitable for both in-ground and above-ground pool constructions, as well as installations which may be partially in-ground.

As previously mentioned, the inner wall 12, instead of pressure treated plywood, could also be molded in plastic panel form from a material such as "Rovel" brand thermoplastic material. The panels could be molded with integral interlocking vertical webs which would replace the vertical studs 16.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A swimming pool sidewall construction for supporting a water containing liner means comprising:

an inner vertical wall of a rigid sheet material including an upper edge and a lower edge;

a water containing liner means disposed against said inner wall;

an outer vertical wall formed of a rigid sheet material, positioned generally parallel to and spaced from said inner wall, said outer wall having a lower edge spaced upwardly from the lower edge of said inner wall and having an upper edge spaced downwardly from the upper edge of said inner wall;

structural stud means including a plurality of spaced-apart vertical studs securing said inner and outer walls together in said spaced-apart parallel configuration;

reinforcing bar means positioned between said inner and outer walls;

a plurality of reinforced concrete sidewall slabs cast in the spaces between said inner and outer walls and said vertical studs and including a concrete footer integral with and joining adjacent concrete sidewall slabs along the space between the lower edge of the inner and outer walls around a bottom perimeter of said pool and extending a distance in a direction away from the pool; and an outwardly sloped gutter means positioned along an upper edge of the outer wall and further including a concrete sill formed in said gutter and integrally joining adjacent concrete sidewall slabs along a top perimeter of said pool.

2. The swimming pool sidewall construction of claim 1 including reinforcing bars positioned in said concrete sill.

3. The swimming pool sidewall construction of claim 1 wherein the structural stud means includes upper and lower horizontal beam members secured to respective ends of said vertical studs, said horizontal beam members having spaced pairs of vertically aligned holes formed therein, each pair of holes positioned substantially mid-way between each of said vertical studs for placement of a reinforcing bar therein.

4. The swimming pool sidewall construction of claim 3 wherein lower ends of said reinforcing bars extend below said lower horizontal beam and are embedded in a subterranean position.

5. The swimming pool sidewall construction of claim 1 wherein the rigid sheet material of the inner wall is a pressure-treated plywood material which is resistant to deterioration.

6. The swimming pool sidewall construction of claim 5 wherein the rigid sheet material of the outer wall is a particle board material.

7. The swimming pool sidewall construction of claim 1 wherein the rigid sheet material of the inner wall is a polymeric material.

8. The swimming pool sidewall construction of claim 1 including drain pipe means positioned above said footer and extending around the bottom perimeter of the pool.

9. A swimming pool sidewall construction for supporting a water containing liner means, comprising:

an inner vertical wall of a rigid sheet material having a smooth side adapted to face said liner means, including an upper edge and a lower edge;

an outer vertical wall of a rigid sheet material, positioned generally parallel to and spaced from said inner wall, said outer wall having a lower edge spaced upwardly from the lower edge of the inner wall and having an upper edge spaced downwardly from the upper edge of said inner wall;

outwardly sloping gutter means positoned along the upper edge of said outer wall;

structural stud means including a plurality of spaced-apart vertical studs securing said inner and outer walls together in said spaced-apart configuration;

reinforcing bar means positioned between said inner and outer walls;

a plurality of reinforced concrete sidewall slabs cast in the spaces between said inner and outer walls and said vertical studs;

a concrete footer formed along the space between the lower edges of the inner and outer walls, integral with and joining adjacent concrete sidewall slabs extending around a lower perimeter of said pool; and a concrete sill formed along the gutter, integral with and joining adjacent concrete sidewall slabs extending around an upper perimeter of the pool.

10. The swimming pool sidewall construction of claim 9 wherein the concrete sill contains reinforcing means embedded therein.

11. The swimming pool sidewall construction of claim 9 wherein the rigid sheet material of the inner wall is a pressure-treated plywood material which is resistant to deterioration.

12. The swimming pool sidewall construction of claim 11 wherein the rigid sheet material of the outer wall is a particle board material.

13. The swimming pool sidewall construction of claim 9 wherein the rigid sheet material of the inner wall comprises a plurality of panels formed of a polymeric material and the spaced-apart stud means are integral vertical webs formed on adjoining edges of each of the panels.

14. The swimming pool sidewall construction of claim 9 including drain pipe means positioned above said footer and extending around the bottom perimeter of the pool.

15. A method of constructing a swimming pool comprising the steps of:

excavating a pool cavity including a sidewall perimeter and a bottom portion;

placing a vertical sidewall form around the perimeter of said cavity, said sidewall form including inner and outer spaced-apart parallel walls including structural stud means and reinforcing bar means positioned therebetween;

providing an outwardly sloped gutter at a top edge of said outer wall;

providing a space at a lower edge of the walls around the perimeter of the pool;

pouring concrete into said sloped gutter to permit the concrete to flow into the spaces between said inner and outer walls and said stud means and at the space at the lower edge to form a plurality of reinforced spaced-apart concrete sidewall slabs therebetween and to form an integral footer of concrete along said space at the lower edge of said sidewalls, said footer extending a distance in a direction away from said pool cavity and joining said sidewall slabs at the lower portions thereof and to form a concrete sill along the gutter to integrally join said concrete sidewall slabs along a top portion thereof at the conclusion of the pouring step;

applying a water-proof liner means adjacent the sheet material of said inner wall and along said pool bottom; and backfilling over said footer and against said vertical sidewall form.

16. The method of claim 15 including the step of embedding reinforcing means in said gutter during said concrete pouring step to reinforce said sill around the pool perimeter.

* * * * *